United States Patent [19]

Sarkisian et al.

[11] 4,138,787

[45] Feb. 13, 1979

[54] DISPLAY HOLDER

[75] Inventors: Robert Sarkisian, 4276 Stoneleigh Rd., Bloomfield Hills, Mich. 48013; David U. Hillstrom, Novi, Mich.

[73] Assignee: Robert Sarkisian, Bloomfield Hills, Mich.

[21] Appl. No.: 660,702

[22] Filed: Feb. 23, 1976

[51] Int. Cl.[2] ..... G09F 7/02

[52] U.S. Cl. ..... 40/618; 40/16; 40/156

[58] Field of Search ..... 40/13, 156, 16.2, 64, 40/63, 140, 142, 124, 5, 618

[56] References Cited

U.S. PATENT DOCUMENTS

| | | | |
|---|---|---|---|
| 1,972,959 | 9/1934 | Taylor | 40/16.2 |
| 2,172,282 | 9/1939 | Hopp | 40/16.2 |
| 2,507,875 | 5/1950 | Williams | 40/145 R |
| 2,815,594 | 12/1957 | Heselov | 40/16.2 |
| 2,882,633 | 4/1959 | Howell | 40/13 X |
| 2,979,842 | 4/1861 | Ridder | 40/156 |
| 3,055,132 | 9/1962 | Madej | 40/140 X |
| 3,171,179 | 3/1965 | Lee | 40/16.4 X |
| 3,310,901 | 3/1967 | Sarkisian | 40/13 X |
| 3,358,395 | 12/1967 | Simonovic | 40/63 R |
| 3,531,884 | 10/1970 | Adler | 40/140 |

FOREIGN PATENT DOCUMENTS

| | | | |
|---|---|---|---|
| 2311969 | 9/1974 | Fed. Rep. of Germany | 40/140 |

*Primary Examiner*—Louis G. Mancene
*Assistant Examiner*—Wenceslao J. Contreras
*Attorney, Agent, or Firm*—Harness, Dickey & Pierce

[57] ABSTRACT

A display holder having track members for securely gripping and holding differently sized posters, signs and advertising materials. The track members comprise elongated extrusions having one or more flange members thereon which mate with corresponding elongated ribs on the backing member of the display holder. The advertising materials are inserted on the display holder so that at least one edge thereof is positioned between a flange member and a rib. The panels are held securely in place by tension. A plurality of frame-like members are preferably positioned on the exterior edges of the backing panel.

28 Claims, 14 Drawing Figures

DISPLAY HOLDER

BACKGROUND — SUMMARY OF THE INVENTION

The present invention relates to an improved sign or display holder and more particularly to a display holder having one or more improved track members thereon for securely gripping, holding and displaying advertising materials.

There are a number of known types of poster, sign, advertising and display holders which are used on a number of different vehicles and structures and in a number of different situations. For example, display holders are typically seen on numerous buildings, such as service stations, train stations, airports and subways, on various styles and types of sign posts and portable stands, and on numerous vehicles, such as trains, busses and taxi cabs. Signs and display holders also are utilized along our roads and highways to supply notices and other information to the public.

Many known signs and display holders, however, often are difficult and time consuming to assemble in the first instance. Also, it is frequently difficult with many holders to change the sign or advertising message without significant effort or disassembly of fastener type parts. Further, many display holders are not adapted to use posters, signs or panels of different sizes and shapes (particularly at the same time). Often the advertising and information materials have to be a certain size or shape in order to fit in the particular sign holder and a small discrepancy of one dimension could make the advertising material useless for the display holder or require substantial alteration of either the holder or the sign.

Moreover, in known display holders where the panel or advertising materials are inserted in a bowed condition, the panels frequently are subject to having wind forces get behind them and slide or dislodge them causing numerous problems to both the advertiser and the public. Also, if a plurality of bowed panels are utilized in one holder, often the panels are bowed to different degrees creating an unpleasing appearance and a difficult message to read.

It is an object of the present invention to provide an improved sign and display holder which overcomes the aforementioned disadvantages of known sign and display holders. The present invention can be used for all types and sizes of posters, signs, advertising materials and panels. Also, it can be used either indoors or outdoors, along roads, and on vehicles, buildings, walls, posts, portable display stands and the like of all types. Portable display devices on which the present invention can be utilized are shown, for example, in U.S. Pat. No. 3,646,696, issued on Mar. 7, 1972, and in U.S. Pat. No. 3,662,482, issued on May 16, 1972. In these two patents, the display holders are connected by a pair of coil springs to a base structure and the springs permit the display holders to deflect in either direction, such as when a strong wind force is applied thereto, without danger of tipping over.

Other objects of the present invention are to provide a relatively uncomplex and simple display holder relative to assembly and utilization, a display holder which can be quickly assembled, an aesthetic, durable and attractive advertising medium, and an inexpensive holder with relatively few parts.

Another object of the present invention is to provide a multi-purpose display holder adapted to handle a plurality of differently sized and shaped advertising materials and panels, the multisized panels being able to be used separately or many at the same time. A further object is to provide a display holder adapted to securely hold and display a number of differently sized advertising or message panels that can be held alternately only on one edge or on two or more edges.

A preferred embodiment of the present invention generally comprises an improved sign or display holder having one or more elongated track members thereon for securely holding, gripping and displaying a plurality of differently sized and shaped advertising materials. The track members have at least one flange member on them which mates with a corresponding elongated ribbed member in the backing surface of the display holder. The track members are attached to the display holder and can be positioned according to the advertiser's needs and desires. The advertising materials or panels are quickly and easily positioned on the display holder with at least one edge inserted between a track flange member and a corresponding rib. In this manner, the panels are held by tension on the holder and the message thereon attractively and suitably displayed. The arrangement of the two pressure points, that is the flange on the track member and the rib on the backing surface, cause the panels to be tensioned and curved inwardly toward the backing surface. The track members are relatively flat and larger advertising materials and panels can be positioned on non-adjacent track members.

Preferably, the display holder has a plurality of track members positioned inwardly of its edges to hold the panels and a second plurality of track or display-holding members along the outer edges thereof forming a frame-like configuration. Such frame-like members can be, for example, similar to those disclosed in U.S. Pat. No. 3,310,901.

The foregoing as well as other objects, features and aspects of the present invention will become apparent from the following description and claims when considered in connection with the accompanying drawings.

BRIEF DESCRIPTION OF THE DRAWINGS

The present invention is described in more detail in the accompanying drawings in which.

DESCRIPTION OF THE PREFERRED EMBODIMENTS

Figure 1:
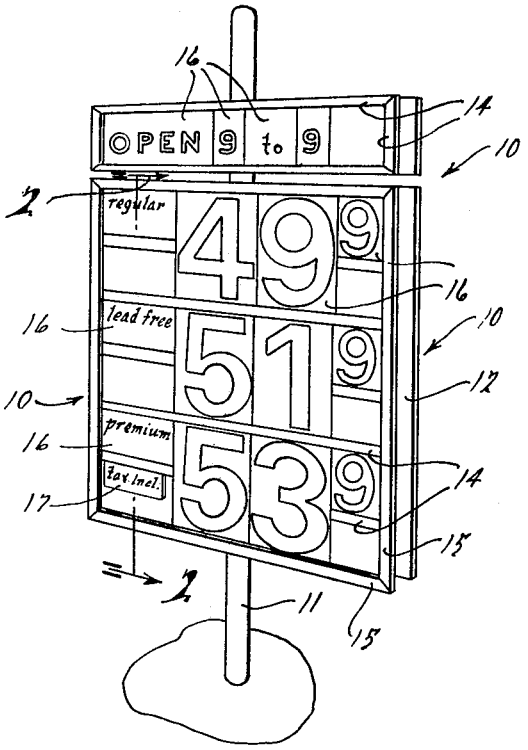
FIG. 1 is a perspective view of an improved display holder in accordance with the present invention and illustrating an actual use thereof.

FIG. 1 illustrates a display holder in accordance with the present invention. In the situation depicted, the invention is adapted for use at a gas or service station. A number of display holders 10 are fastened to a post or other member 11. In FIG. 1, four display holders 10 are situated on one sign post 11, but it is understood that any number of display holders can be utilized according to the needs and desires of the station owner or advertiser. The display holders 10 also can be fastened to a sign post, portable stand, wall or vehicle. The holders 10 can be attached to these items in any conventional manner, such as by mounting brackets, bolts, clamps and the like (not shown).

Each display holder 10 consists of a backing panel or backing member 12 and a number of track members or track units 14 which are adapted to be positioned on or attached to the backing member 12. The display holders are adapted to securely hold and display one or more panels, posters, signs, advertising materials, and the like 16 on the face thereof for display.

Figure 3:
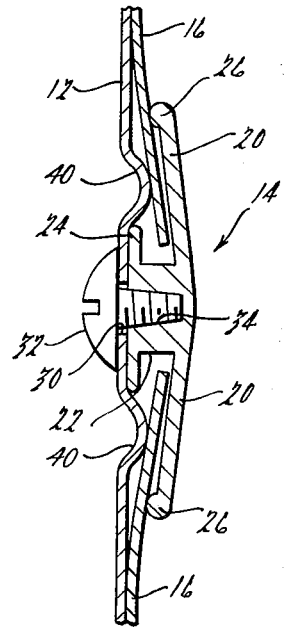
FIG. 3 is an enlarged view of one of the track members shown in FIG. 2 illustrating one embodiment of the invention.

A track unit 14, in accordance with the present invention, is shown in detail in FIG. 3. The unit 14 preferably comprises a generally T-shaped or I-shaped extrusion having one or more flange members 20, a central core or stem 22, and a base portion 24. The track units 14 can have either one or two flange members 20 on them. Small nubs or rounded portions are situated at the outer ends 26 of the flange members 20 to assist in holding the panels 16 in the display holder and to lead the sign panels 16 in place. Preferably, the flange members 20 slant downwardly from the stem 22 toward the ends 26 to allow the display panels 16 to be inserted easily on the display holder and at the same time to be held firmly in place.

The track units 14 are made of a rigid metal material such as aluminum, but they can also be made of plastic or another appropriate material. Since the display holders 10 are capable of use both indoors and outdoors, the track units 14 should be made of material which will not rust, discolor, or deteriorate. The track units 14 can be made in any conventional manner, but preferably are extruded in elongated units in the shape shown in the drawings and cut to the desired length. Also, the outer face (or top) of each of the track units 14 preferably is painted in a matching or contrasting color to the desired advertising panels. If the units 14 are made the same color as the background of the advertising or sign panels, they will be less noticeable and will not detract from the message on the display holder.

The backing panel 12 consists of a relatively rigid metal material such as aluminum, but it is understood that it can be any other material, such as Masonite or molded plastic, which meets the requirements of the present invention. Similar to the track units 14, the backing panel 12 should be made of a material which will not rust, discolor or deteriorate during use and exposure to the elements. Hence, the backing panel 12 preferably should be made of a material having durability, a substantial long life, an ability to maintain its integrity and quality throughout its life, and a pleasing appearance. The material also should be formable so that the requisite ribbed members as described herein can be formed in it.

The track units 14 preferably are placed horizontally on the interior of the backing panel 12 and are adapted to attractively and securely hold and display an advertising message, such as the price of gasoline at a service station, by means of sign panels or fonts 16 with appropriate numbers, letters, or the like thereon. The display holders and sign panels are normally designed in combination so that the track units will be positioned at predetermined spaced locations on the backing member and the sign panels are provided of certain sizes to fit between the track members. The sign panels 16 are quickly and easily interchangeable, as discussed in more detail below, to change the prices or advertise other products or services.

The sign panels, posters or advertising materials 16, which can be utilized in the display holder 10, can be of any conventional design. The sign panels should be relatively stiff and durable so that they can be repeatedly inserted into and removed from the track units 14 without being bent, creased, or permanently deformed. Since the present invention is adaptable for use both indoors or outdoors, the sign panels 16, similar to the remaining parts of the display holder 10, should be made of a material which will not rust, discolor or deteriorate. Sheet metal panels made of aluminum with baked enamel messages thereon have shown to have the desired advantages and features.

The track units 14 can be attached to the backing panel 12 on the display holder 10 in any conventional manner, such as indicated in FIG. 3. A hole or slot 30 is provided in the backing member 12 and a screw 32 or other fastening means is inserted through the hole 30 and secured into a corresponding opening or slot 34 in the track unit 14. Self-tapping screws 32 have shown to be useful for this application.

A number of elongated ribs or generally hump-shaped projections 40 are provided on the backing panel 12. The ribs 40 are adapted to mate with the track units 14 to securely hold the panels 16 in place on the display holder 10 in the manner shown in FIG. 3. One rib 40 is provided for each flange 20 on the display holder 10; thus, the backing panel 12 should be designed for the particular use to which the holder will be put. If the track unit 14 has two flanges 20, two corresponding ribs 40 are provided on the backing panel 12 in the appropriate positions.

The ends 26 of the track units and the ribs 40 on the backing member 12 provide two pressure points which act on the sign panels 16. The two pressure points are arranged such that the panels 16 will be put in tension on the holder 10. The tension causes the panels 16 to be curved inwardly toward the backing member 12 and to be firmly secured in place. The panels lie flat in the display holder which is particularly important for large sized panels. Panels held in position in accordance with the present invention cannot be dislodged or displaced by wind forces and will not fall out even if the display holder itself is accidently dropped or turned over.

Figure 2:
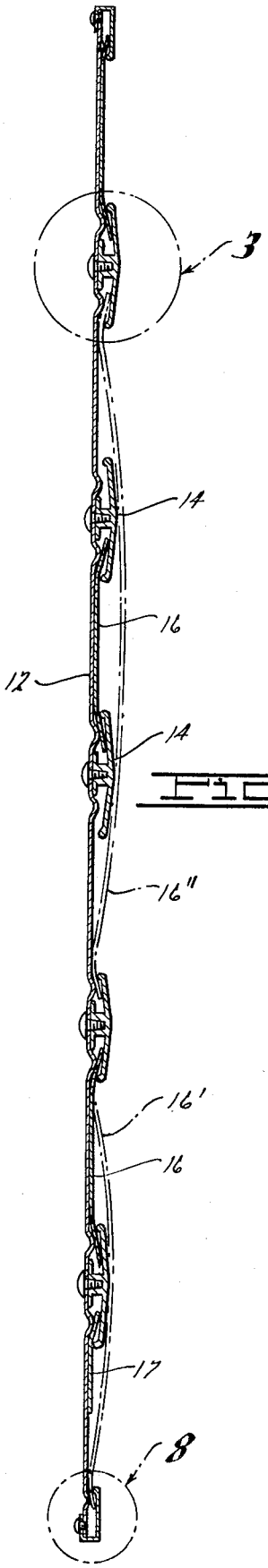
FIG. 2 is basically a cross-sectional view taken along line 2—2 of FIG. 1.

The preferred positioning of the pressure points and the tension applied thereby to the sign panels 16 is shown in FIGS. 2 and 3. As shown in FIG. 2, the panels 16 are bowed or curved inwardly such that they come in contact with the backing member 12 between adjacent track units 14. The tension and inward curvature applied to a sign panel 16 is sufficient to hold it firmly and securely in place even if the sign panel 16 is only held on one edge thereof. Thus, it is possible with the present invention to use panels 16 which are too small to be inserted into and be held by two adjacent track units 14.

The present invention is also adapted to securely hold in place and display sign panels which are smaller and larger than the area between adjacent track units 14. This permits much flexibility and design choice in creating different advertising messages and highlighting and accenting various features of the message. As shown in dashed lines in FIG. 2, larger-sized sign panels 16' and 16'' are positioned between non-adjacent track units 14. The panel 16' is positioned over one track unit 14 and the panel 16'' covers over two intermediate track units. Due to the tension produced by the flange and rib pressure points, the panels 16' and 16'' are tensioned toward the backing member 12 and hence are forced against and rest on the tops of the intermediate track units 14. In the same manner, it is obvious that the inventive display holder 10 will easily and firmly hold in place a sign panel which extends the entire height of the holder 10 and is secured in the uppermost and lowermost track units.

When smaller-sized panels are used, that is panels which are too narrow to fit between two adjacent track units 14, they are held securely in place by only one track unit. The tension produced on the panel by the one track unit causes it to lie flat on the display holder. A smaller-sized panel 17 is shown in position on a display holder 10 in FIGS. 1 and 2.

The dimensions of the sign panels should be such that they stretch easily between adjacent or non-adjacent track units. The height of the panels does not have to be within exact limits, however, as the design of the track units and position of the pressure points provides sufficient clearance space for non-uniformly dimensioned panels. This is shown, for example, in FIG. 3 where clearance spaces are shown between the ends of the panels 16 and the outer surfaces of the stem portion 22. The sign panels 16 can be of any convenient transverse width, depending on the numeral or message which is printed thereon.

As shown in FIGS. 1 and 2, a number of track units 14 are provided on each backing panel 12 in order to hold and display a number of advertising panels and a number of differently sized panels. It is possible, of course, to only provide track units 14 near or on the upper and lower edges of the backing member 12 and thus provide only one line or space for a display. This could happen, for example, where the display holder is small in size (as shown in the uppermost display holder in FIG. 1), or where only large sign panels are to be displayed in it.

In the preferred embodiment of the invention, a plurality of track units 14 are provided in the interior of the backing member 12 and a number of frame members 15 are provided on the outer edges thereof. The track units 14 can be positioned horizontally (as shown in FIG. 1), vertically, or in any desired combination of horizontal, vertical or other positions in accordance with the desires of the owner or advertiser.

Frame members 15 which can be utilized for the display holder are shown in U.S. Pat. No. 3,310,901, the subject matter of which is incorporated by reference herein. The holder assembly shown in that patent is adapted to be assembled on the exterior edges of a backboard to provide a display holder. One of the embodiments of that patent is shown in FIG. 4 herein to show its use and adaptability with the present invention.

Figure 4:
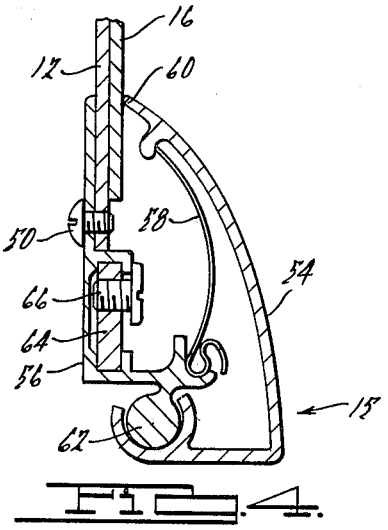
FIGS. 4, 5 and 6 illustrate embodiments of frame members which can be utilized along the edges of the display holder.

Although the edge-type holder assembly shown in FIG. 4 is described in detail in U.S. Pat. No. 3,310,901, a brief description thereof is appropriate. As shown in FIG. 4, the holder assembly is adapted to be attached to backing panel 12 by one or more screw means 50. The panel or display members 16 are then inserted in the member 15 and securely held in place against the backing member 12. The member 15 generally comprises two pivotably hinged portions 54 and 56 which are biased to a closed position by leaf-spring 58. The end 60 of portion 54 is biased by the spring 58 to hold the sign panel 16 in place. The portions 54 and 56 of the member 15 are pivoted around pintle formation 62 which is formed on and projects from portion 56.

Where four separate members 15 are provided around the outer edges of the backing panel 12, the corners are mitered 45° for abutting and coplanar assembly with one another to outline and make a frame-like assembly thereon. For this purpose, L-shaped corner braces or brackets 64 are provided which are slipped into the ends of adjacent members 15 so that they can be brought into tight mitered engagement. Screw means 66 which abut on a portion of portion 56 securely hold the corner braces 64 in place.

Where the frame-type members 15, as illustrated in FIG. 4, are provided on the backing panel 12 forming the display holder 10, the track units 14 positioned on the interior of the backing panel 12 are provided of sufficient length to be positioned immediately adjacent the position of the ends 60 of the portion 54 when the member 15 is closed. In that manner, when the sign panels 16 are inserted on the display holder, the complete frame and track unit assembly will appear to be a single unit. In this regard, the members 15 should be color coordinated to match the track units 14.

Figure 5:
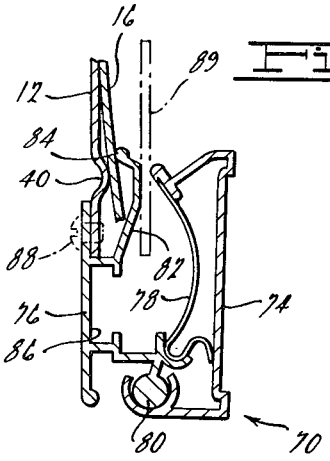

Another embodiment of a frame-type member utilizable with the display holder 10 is shown in FIG. 5. It is indicated generally by numeral 70. The members 70 are adapted to be positioned on all of the edges of the backing panel 12, but preferably are utilized only the upper and lower edges thereof in combination with the members 90 shown in FIG. 6. The member 70 has two pivotably hinged portions 74 and 76 which are biased to a closed position by leaf-spring 78. The portions 74 and 76 are pivoted around pintle formation 80 which is formed on and projects from portion 76. The portion 76 also has a flange means 82 thereon which is similar to and serves the same purpose as the flange members 20 on the track units 14. In this regard, a small nub or rounded portion is provided at the outer end 84 of the flange means 82. The end 84 cooperates with the rib 40 in the backing member 12 to provide the requisite pressure points to firmly and securely hold the sign panels 16 in place.

Four members 70 (or a combination of members 70 and 90) are positioned around the outer edges of the backing panel 12 to make a frame-like assembly. The corners are mitered for abutting and coplanar assembly with one another and L-shaped corner braces or brackets (not shown) are slipped into grooves 86 in adjacent members so that they can be brought into tight metered engagement. Since the four members form a tight frame around the backing panel 12, it is unnecessary to otherwise secure the panel 12 to the members. If desired, however, the members 70 can be secured to the panel 12 by any conventional means, such as screw means 88 shown in dashed lines in FIG. 5.

Not only do the members 70 provide an attractive, useful frame for the display holder 10, they provide another securing means for a sign panel or other advertising medium. As shown in dashed lines in FIG. 5, a panel or poster 89 can be positioned between the portions 74 and 76. The portion 76 which is biased by spring 78 holds the panel 89 in place. Thus, a display holder with members 70 positioned on its edges can display either a plurality of panels 16 held in place against the backing panel 12, or a single large poster 89 covering the entire interior of the holder.

Figure 6:
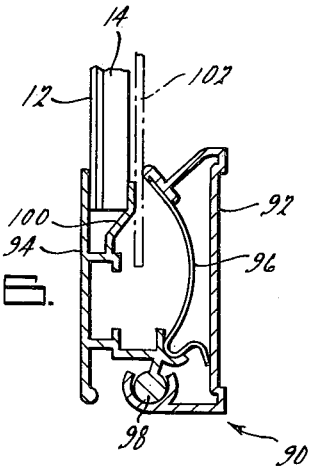

A further embodiment of a frame-type member which can be used with the display holder is shown in FIG. 6. The member 90 has two pivotably hinged portions 92 and 94 which are biased to a closed position by leaf spring 96. The portions 92 and 94 are pivoted around pintle formation 98 which is formed on and projects from portion 94. The portion 94 also has a flange means 100 thereon which is adapted to firmly hold an edge of the backing panel 12 with one or more track units 14 thereon. Hence, the members 90 are adapted to be positioned on the sides of a backing panel 12 which has a plurality of horizontally extending track units 14 thereon. If frame-like members 90 are utilized, of course, the track units 14 should extend to the outer edges of the panel 12. As mentioned above, a pair of members 90 can be used in combination with a pair of members 70 (or a pair of members 15) to form an advantageous frame-like outline for the display holder. Where the track units 14 are positioned horizontally on the backing panel 12 (as should be the case with most display holders), members 70 will be positioned on the top and bottom edges of the panel 12 while members 90 will be positioned on the two side edges thereof. The corners of the four members are mitered forty-five degrees for abutting and coplanar assembly with one another and L-shaped corner braces (not shown) are positioned in each of the corners to hold the ends of the adjacent members in tight mitered engagement.

Figure 7:
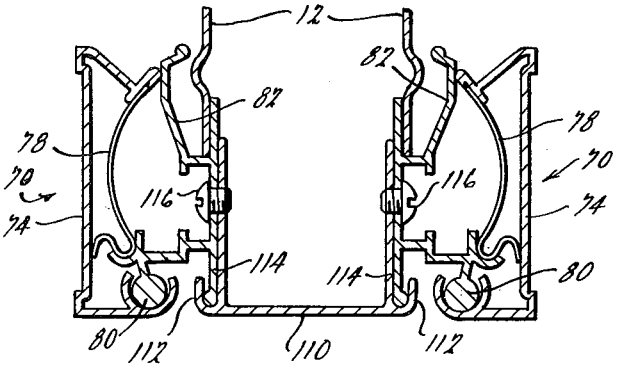
FIG. 7 illustrates a unique means for mounting two display holders together.

Similar to the member 70, the members 90 also provide a means for securing a large poster 102 (shown in dashed lines in FIG. 6) on the display holder. The poster 102 is positioned between portions 92 and 94 and is held in place by spring 96 which biases portion 94 in the position illustrated in the drawings.

Where two display holders utilizing members 70 or 90 are to be displayed back-to-back, mounting means 110 can be utilized (FIG. 7). The mounting means 110 generally comprises an elongated U-shaped channel with a pair of J-shaped mating grooves 112 which mate with flanges 114 on members 70 (or 90). The members 70 (or 90) are secured to the means 110 by a plurality of screw means 116 which are hidden from view inside the members.

Figure 8:
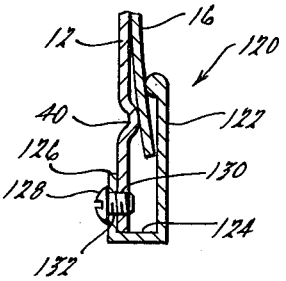
FIGS. 8 and 9 are embodiments of track members which can be utilized along the edges of the display holder in accordance with the present invention.

It is also possible to use a plurality of track units 14 on the outer edges of the backing panel 12, instead of frame-like members 15, 70 and/or 90. In this regard, a track unit having only one flange preferably is utilized. One embodiment of such a construction is shown in FIG. 8. The edge track unit 120 is J or U-shaped in cross-section and has one flange 122 attached to a stem portion 124 and a base portion 126. The base portion 126 is adapted to contain a means for attaching the unit 120 to the backing member 12. In the embodiment shown in FIG. 8, a self-tapping screw 128 is provided which mates with a corresponding hole 130 in the backing member 12 and a hole 132 in track unit 120. The precise shape of the track unit 120 is not critical so long as it has a flange or outwardly extending arm portion providing a pressure point for the sign panel 16 for cooperating with a corresponding rib in the backing member 12 forming the second pressure point.

If the track units 120 are used on the side edges of the backing member 12, elongated rib members 40 can be provided along the side edges for mating with each of the track units 120. In this manner, the advertising materials or sign panels 16 can be securely held in place in the same manner as described above relative to the track unit 14. If the display holder 10 is utilized in the manner as shown in FIG. 1, namely upright with the track units 14 positioned only horizontally thereon, it is preferable to provide edge-type track units 120 only on the upper and lower edges. Thus, it is necessary only to provide ribs 40 horizontally on the backing panel 12. If desired, particularly to complete the outer frame for the display holder 10, dummy track units 14 or 120 can be provided on the side edges without corresponding ribs 40.

Figure 9:
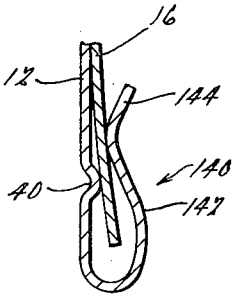

Rather than utilizing separate track units 14 or 120, or frame-type members 15, 70 or 90 on the outer edges of the display holder 10, it is also possible to fold or roll-over the edges of the backing member 12 to form the requisite pressure points and holding members. Such an embodiment is shown in FIG. 9. When the backing member 12 is fabricated, the outside ends thereof are rolled over as shown in FIG. 9 providing a track-like unit assembly 140. The assembly 140 has a flange 142 with a turned-up projection 144 thereon. The bend forming the projection 144 provides the pressure point to assist in holding the sign panels 16 in place. It is also possible to provide a knob-like projection on the flange 140 similar to knobs on the ends 26 of track units 14. Mating with the flange 142 and projection 144 is a corresponding rib 40 in the backing panel 12. Hence, the panel 12 itself is utilized to easily and simply define its own outer track units. The assembly 140 can be used on any number of the outer edges of the backing panel 12; they can also be used in combination with track units 14 or 120.

Figure 10:
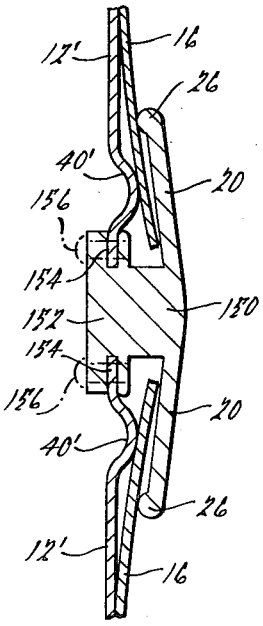
FIG. 10 illustrates another embodiment of a track member in accordance with the present invention.

Another embodiment of the invention is shown in FIG. 10. In this embodiment, the panel 12 is comprised of a number of separate panel sections 12'. Each of the sections 12' has a rib 40' for mating with the track unit 150 and holding the sign panels 16 in place. The flanges 20 and ends 26 on the track unit 150 are similar to those described above with reference to FIG. 3. The base portion is different, however. In the embodiment shown in FIG. 10, the base portion 152 has one or more slots, grooves or channels 154 therein for mating with and holding the separate backing panel sections 12'. Preferably, the channels 154 in the track units 150 are adapted to frictionally hold the sections 12' in place. When the complete display holder 10 is assembled, all of the various backing panel sections 12' will be held securely in place as a result of the composite assembly and track units positioned and secured thereon. If desired, however, a number of screw means 156, as shown in dashed lines in FIG. 10, can be provided to securely hold the panel sections 12' in place adjacent the corresponding track units 150.

Figure 11:
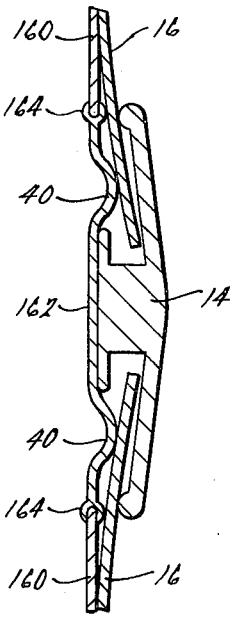
FIG. 11 illustrates a display holder having a backing panel comprised of a number of portions joined together.

As shown in FIG. 11, the backing panel 12 can also be comprised of a number of stamped panel sections 160 and extruded portions 162. The extruded portions 162 contain one or more ribs or mounds 40 for mating with the track units 14, and the backing panel sections 160 are inserted in mating recesses in the ends 164 of the portions 162.

Figure 12:
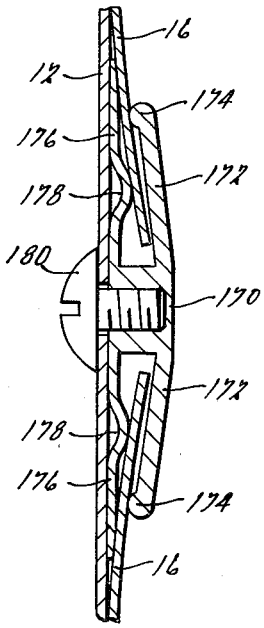
FIG. 12 illustrates still another embodiment of a track member in accordance with the present invention.

In another embodiment of the invention, a track unit 170 is provided which incorporates both of the pressure points to hold the sign panels 16 in place by tension. The track unit 170 is extruded in the shape shown in FIG. 12. The unit 170 is generally H-shaped in cross-section having on one side two flanges 172 with knobs on the ends 174 thereof and on the other side having two flanges 176 with elongated ribs 178 thereon. The ends of the flanges 178 are relatively thin and project beyond the ends 174 of the flanges 172 so that the panels 16 can be inserted easily in the track units between the sets of flanges. The backing panel 12 comprises a flat sheet and is connected to the units 170 by a plurality of screw means 180.

Figure 13:
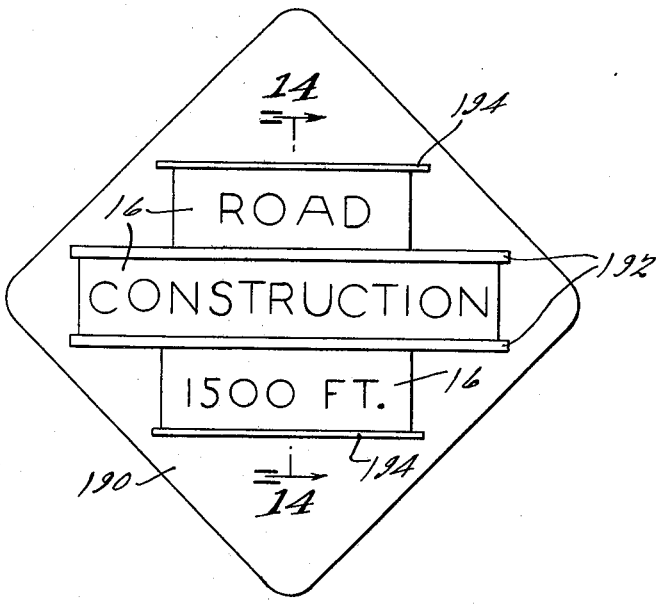
FIG. 13 illustrates the use of the present invention on a road construction sign.
Figure 14:
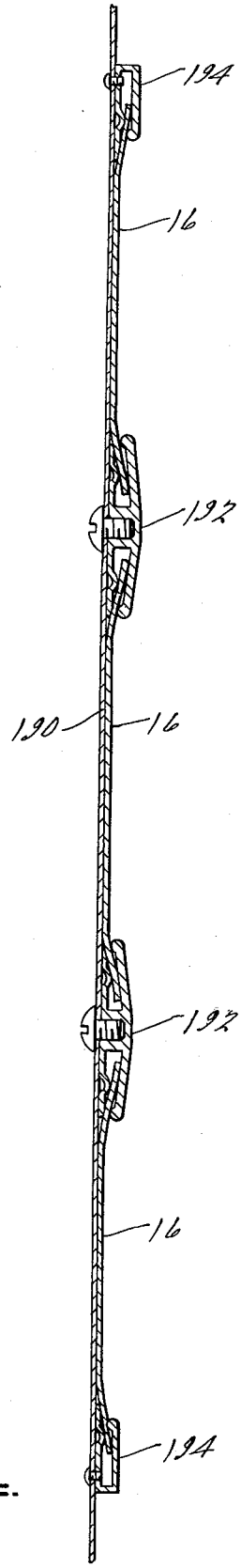
FIG. 14 is a cross-sectional view taken along line 14—14 of FIG. 13.

The present invention can be utilized for all variations and types of signs and display holders. It can be utilized, for example, with road, highway and construction signs, as shown in FIGS. 13 and 14. A pair of track units 192 are positioned in the middle of the construction sign 190 and a pair of edge-type track units 194 are positioned above and below the track units 192. For this embodiment, the track units 192 are similar to track units 170 shown in FIG. 12. The track units 194 illustrated are similar to edge track units 120 discussed above with reference to FIG. 8 (with a longer extending rear leg 126), although it is understood that the units 194 can be of any appropriate configuration.

The notice to the public is provided by removable panels 16 having preprinted messages thereon. With the sign 190, an uncountable number and variations of messages, warnings, and notices to the public can be displayed. Instead of providing a large number of individual signs, each painted with a different message, only a limited number of signs 190 need to be provided together with a plurality of removable and interchangeable message panels 16.

It is to be understood that the foregoing description describes preferred embodiments of the invention. Various changes and modifications may be made without departing from the spirit and scope of the invention as defined by the appended claims.

We claim:

1. A display holder for displaying sign panels, said sign panels being held securely in place without permanent deformation and adapted for repeated use and reuse in said display holder, said display holder comprising a substantially flat backing member, at least one track member positioned on and secured to said backing member, said track member having a pair of flanges thereon forming elongated channels between each of said flanges and said backing member, each of said channels having an inner end and an outer open end, said sign panels being receivable into selected of said channels through said open end thereof, first rib means on each of said flanges adjacent the open ends of said channels and extending inwardly into said channels, and second rib means on said backing member adjacent each of said channels, said second rib means extending inwardly into said channels and positioned in each of said channels between said first rib means and the channel inner end, said first and second rib means extending inwardly into each of said channels such that said sign panels positioned in said channels and abutting against the respective rib means associated therewith are held tightly in tension in said channels without permanently deforming said sign panels, said first and second rib means automatically biasing the portion of the sign panels outwardly of each of said channels in a direction toward the plane of and into engagement with said backing member.

2. The invention as defined in claim 1 wherein said backing member is comprised of a plurality of sections.

3. The invention as defined in claim 2 wherein at least one of said sections comprises an extruded assembly having at least one rib means thereon.

4. The invention as defined in claim 2 wherein said track members have means thereon for receiving at least one of said sections.

5. The invention as defined in claim 4 wherein said sections are frictionally secured in said last mentioned means.

6. The invention as defined in claim 4 further comprising means for securing said section in said last mentioned means.

7. The invention as defined in claim 1 further comprising at least one frame-like edge member, said edge member positioned on an edge of said backing member and having a first portion and a second portion pivotably connected together and a bias means, said bias means positioned to bias the first and second portions in a clamping relationship.

8. The invention as defined in claim 7 wherein said first portion has a flange means thereon adapted to mate with a corresponding rib means on said backing member and to contact said sign panels.

9. The invention as defined in claim 7 wherein said first portion has a flange means thereon adapted to releasably hold an edge of said backing member and an end of at least one track member.

10. The invention as defined in claim 7 wherein the backing member is rectangular, one of said edge members is secured along each of said edges forming a frame-like assembly, and a plurality of track members are horizontally positioned on said backing member forming a plurality of holding means for said sign panels.

11. The invention as defined in claim 1 wherein at least one edge of said backing member has both a rib means and a flange means thereon.

12. The invention as defined in claim 11 wherein two edges of said backing member have both rib means and flange means thereon.

13. The invention as defined in claim 12 wherein said two edges are on opposite sides of said backing member.

14. The invention as defined in claim 1 wherein said display holder is mounted on pole means.

15. The invention as defined in claim 1 wherein said display holder is mounted on wall means.

16. The invention as defined in claim 1 wherein said display holder is mounted adjacent a second similar display holder and the two display holders are connected together by at least one U-shaped mounting means.

17. The invention as defined in claim 1 wherein said track member is comprised of extruded aluminum and has a substantially T-shaped cross section.

18. The invention as defined in claim 1 wherein said backing member is polygonal in shape and at least one track member is positioned on an edge thereof.

19. The invention as defined in claim 18 wherein said backing member is rectangular.

20. The invention as defined in claim 1 wherein said track members are positioned around the perimeter of said backing member forming a frame-like assembly thereon.

21. A display holder for displaying sign panels, said sign panels being held securely in place without permanent deformation and adapted for repeated use and reuse in said display holder, said display holder comprising a substantially flat backing member, a plurality of track members positioned on and secured to said backing member, each of said track members having a flange thereon forming an elongated channel between said flange and said backing member, said channel having an inner end and an outer open end, said sign panels being received into said channel through said open end thereof, first rib means on said flange adjacent the open end of said channel and extending inwardly into said channel, and second rib means on said backing member, said second rib means extending inwardly into said channel and positioned between said first rib means and said inner end of said channel, said first and second rib means extending inwardly into said channel such that said sign panels positioned in said channel and abutting against each of said rib means are held tightly in tension in said channel without permanently deforming said sign panels, said rib means automatically biasing the portion of the sign panels outwardly of said channel in a direction toward the plane of and into engagement with said backing member.

22. The display holder set forth in claim 21 wherein each of said track members has two flanges thereon, each of said flanges forming elongated channels and having said first and second rib means therein.

23. The display holder set forth in claim 21 wherein said track members are substantially T-shaped in cross-section.

24. The display holder set forth in claim 21 wherein said backing member is retangular.

25. The display holder set forth in claim 21 further comprising at least one frame-like edge member, said edge member positioned on an edge of said backing member and having a first portion and a second portion pivotably connected together and a bias means, said bias means positioned to bias the first and second portions in a clamping relationship.

26. The display holder set forth in claim 25 wherein the backing member is rectangular, one of said edge members is secured along each of said edges forming a frame-like assembly, and a plurality of track members are horizontally positioned on said backing member forming a plurality of holding means for said sign panels.

27. The display holder set forth in claim 21 wherein at least one edge of said backing member has both a rib means and a flange means thereon.

28. The display holder set forth in claim 21 wherein said track members are positioned around the perimeter of said backing member forming a frame-like assembly thereon.

* * * * *